United States Patent [19]

Simmonds

[11] 4,396,291

[45] Aug. 2, 1983

[54] MOTOR DRIVEN PAINT MIXER

[76] Inventor: William Simmonds, 6120 Elder Creek Rd., Sacramento, Calif. 95824

[21] Appl. No.: 354,341

[22] Filed: Mar. 18, 1982

[51] Int. Cl.[3] ..... B01F 13/04

[52] U.S. Cl. ..... 366/282; 361/92; 366/601

[58] Field of Search ..... 366/282, 281, 284, 285, 366/286, 601, 241; 361/92, 33, 90

[56] References Cited

U.S. PATENT DOCUMENTS

| | | | |
|---|---|---|---|
| 1,179,637 | 4/1916 | Kruse | 361/90 |
| 2,115,956 | 5/1938 | Jorgenson | 366/282 |
| 2,697,195 | 12/1954 | Courtney | 361/33 |
| 3,068,186 | 12/1962 | Paulus | 366/282 |
| 3,223,389 | 12/1965 | Simmonds | 366/282 |

*Primary Examiner*—Robert W. Jenkins
*Attorney, Agent, or Firm*—Mark C. Jacobs

[57] ABSTRACT

A motor driven paint mixer which is designed to prevent accidental and/or unintentional actuation is disclosed. The paint mixer comprises a two speed electric motor having a motor shaft, a detachable extension shaft mechanically coupled at one end to the motor shaft and having paint mixing elements at the other end thereof, a support assembly for supporting the electric motor on one side of a paint can, a power supply cord for connecting the electric motor to an electrical power source and a control box mechanically mounted on the electric motor and electrically interposed in the power supply cord connected to the electric motor. The control box includes a double throw double pole toggle switch having two on positions and a center off position and a relay. The relay and switch are connected in series and operate in a manner such that if there is a loss in power to the electric motor for any reason while the switch is in an on position the relay will open and remain open after the power has been restored until the switch is first returned to the off position and then moved to an on position. The toggle switch is mounted in a recessed portion of the control box to minimize the possibility of accidentally moving from the off position to an on position.

4 Claims, 3 Drawing Figures

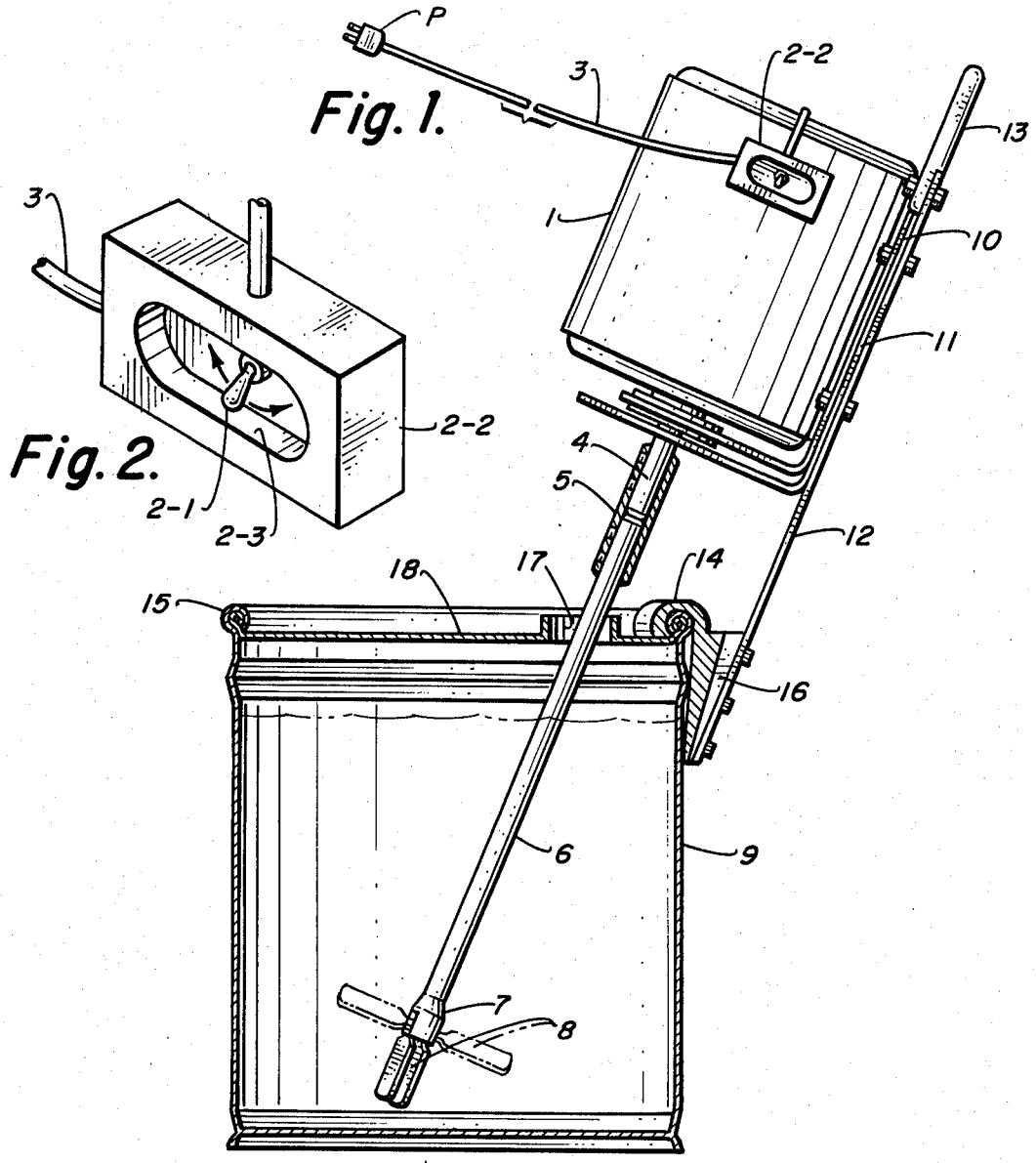
Fig. 1.
Fig. 2.
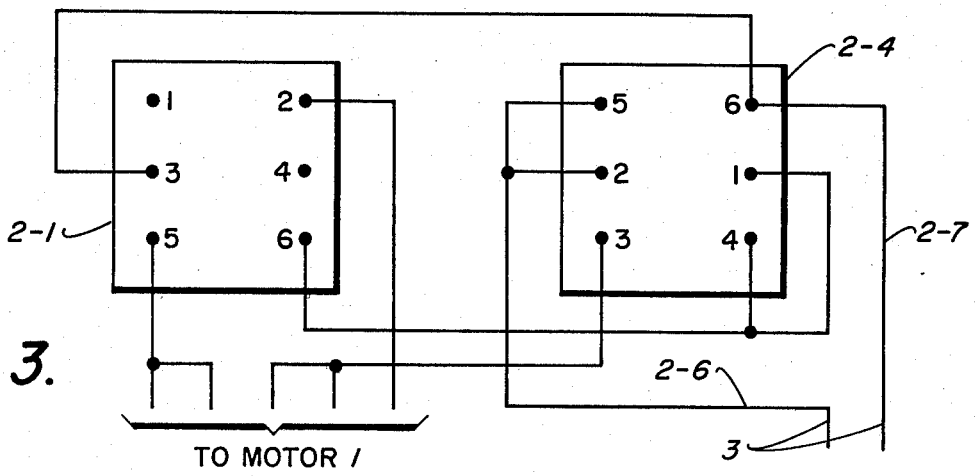
Fig. 3.

MOTOR DRIVEN PAINT MIXER

BACKGROUND OF THE INVENTION

The present invention relates in general to a portable, electric motor driven paint mixer and more particularly to a portable, electric motor driven paint mixer which is designed to minimize accidental and/or unwanted actuation of the electric motor.

In U.S. Pat. No. 3,223,389, which issued to C. S. Simmonds on Dec. 14, 1965, and which patent is incorporated herein by reference, there is disclosed a portable, electric motor driven paint mixer which is intended for use primarily with mixing paint in large cans such as standard five gallon cans, or larger. The paint mixer includes a motor, a detachable shaft having a pair of folding impeller (mixing) blades and a support frame for mounting the motor on the top edge of a paint can whose contents are to be mixed. The electric motor is turned on and off by means of a toggle switch located on the top of the can.

One of the potential problems with the toggle switch as mounted on paint mixer is that if it is accidentally moved from an off position to an on position the motor will start. For safety and other reasons, this arrangement is undesirable. The present invention overcomes this problem by mounting the toggle switch in a recessed portion of a housing so that it cannot be accidently moved to an on position.

Another potential problem with the paint mixer is that if the plug on the power supply cord from the motor to the AC outlet is accidently or inadvertently pulled or kicked out from the AC outlet while the switch is in an on position and the motor is running, upon reinsertion of the plug into the outlet the motor will be reneergized and restarted immediately. For safety and other reasons, this arrangement is also undesirable. The present invention overcomes this potential problem by coupling the switch in series with a relay. If for any reason there is a power loss to the motor while the motor is on (i.e. such as by the plug being accidentally removed from the outlet) the relay will move into an open position and remain open until the switch is first moved to the off position and then moved to an on position.

Accordingly, it is an object of this invention to provide a new and improved portable, electric motor driven paint mixer.

It is another object of this invention to provide a paint mixer as described above in which the likelyhood of the motor being accidentally turned on is at a minimum.

It is still another object of this invention to provide a paint mixer as described above in which the motor can only be energized by first placing the switch in an off position and then moving the switch to an on position.

The foregoing and other objects and advantages will appear from the description to follow. In the description, reference is made to the accompanying drawings which form a part thereof, and in which is shown by way of illustrating, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

SUMMARY OF THE INVENTION

A paint mixer for use in a paint can constructed according to the teachings of the present invention comprises an electric motor, said electric motor having a motor shaft, a detachable extension shaft mechanically coupled to said motor shaft and having paint mixing elements thereon, means detachably supporting the electric motor on one side of the can, a power supply cord for electrically connecting said electric motor to an electric power source, and a control box mechanically mounted on the electric motor and electrically interposed in the power supply cord leading to the electric motor for energizing and deenergizing the electric motor, said control box including a switch having an off position and at least one on position and a relay coupled to the switch to prevent restart of the electric motor on a loss of power from the electrical power source while the switch is in an on position until the switch is first returned to an off position and then moved to an on position, once the power has been restored.

BRIEF DESCRIPTION OF THE DRAWINGS

In the drawings wherein like reference numerals represent like parts:

FIG. 1. is a side elevation view of a paint mixer constructed according to the teachings of the present invention, partly broken out and in section, shown as mounted on a closed paint can;

FIG. 2 is an enlarged perspective view of the control box shown in the paint mixer of FIG. 1; and FIG. 3 is an electrical circuit diagram of the control box shown in FIG. 1.

DETAILED DESCRIPTION OF PREFERRED EMBODIMENT

Referring now to the drawings, there is illustrated an embodiment of a paint mixer constructed according to the teachings of the present invention. The paint mixer comprises a two speed electric motor, such as a Dayton ¼-½ HP split phase 115 V motor model number 5K618, controlled by a DPDT switch 2-1, such as a Honeywell MicroSwitch model number 12T595-10 having two on positions and a center off position, located in a control box 2-2 which is physically mounted on the side of the motor 1 and electrically interposed in the current supply cord 3 leading to the motor 1. As can be seen more clearly in FIG. 2, the control box 2-2 has a recessed top portion 2-3 and the switch 2-1 is desposed within the recessed portion. In order to move the switch 2-1 it is necessary to actually reach into the recessed portion 2-3. As a result, the likelyhood of the switch 2-1 being accidently hit and moved to an on position is greatly minimized.

In addition to switch 2-1, there is located inside the control box 2-2 a relay 2-4, such as a Dayton DTDP relay model number 5X847A, which is electrically connected in series with the switch 2-1. The relay 2-4 and switch 2-1 are arranged such that if for any reason there is a loss in power while the switch is in an on position, after the power is restored the switch must first be moved to the off position and then moved to an on position before the motor is activated. A temporary loss in power can occur, for example, if the plug P at the end of the supply cord 3 is accidently removed from a power supply socket and then plugged in again.

The lower end of the motor shaft 4 is detachably connected, by a coupling sleeve 5, with an elongated extension shaft 6 which is thus in effect a part of the motor shaft itself.

The lower end of the shaft 6 is formed with an enlarged vertically slotted head 7 in which a pair of separately pivoted mixing paddles 8 are mounted. The arrangement is such that the paddles 8 may depend from the head 7 in substantial alignment with the shaft 6 and in side-by-side relation as shown in full lines in FIG. 1, or by reason of rapid rotation of the shaft and the resultant centrifugal action, may swing out to extend at right angles to the axis of the shaft as indicated in dotted lines in FIG. 1. The shaft 6 being removable, other shafts, having paddles of different shapes or pitches, may be installed in lieu thereof.

The motor 1 is adapted to be supported from a large standard size paint can 9 in the following manner:

A C-shaped frame 10 straddles and is mounted on the motor 1; such frame including a straight portion 11 adjacent and parallel to one side of the motor. A pair of transversely spaced rigid bars 12 are secured to and depend from said frame portion 11; said bars at their upper end being connected by a cross handle 13 so that the device can be easily carried and manipulated.

At their lower end, the bars 12 extend some distance below the sleeve 5 and are secured on an arcuate hanger 14 having a curvature the same as that of the periphery of the can 9. The hanger 14 is shaped in cross section to engage over the rim head 15 of the can 9 in holding relation as shown in FIG. 1; such hanger including a depending leg 16 which engages the outside of the can some distance below the head 15, and to the back of which leg 16 the bars 12 are secured.

When the mixer is to be used, the can 9 remains closed and the only access to the interior thereof is had through the initially capped or alternately cut pouring opening 17 in the lid 18 of the can and which opening is as usual close to one side of the can as shown. The hanger 14 is designed and positioned relative to the bars 12 and the shaft 6, and with regard to the distance from the opening 17 to the can rim head 15, so that said shaft 6 will project through such opening 17 when the hanger 14 is engaged with the rim head 15. Also, the mixer as a whole will then be disposed at an acute angle to the axis of the can and such that the lower end of the shaft 6, and the paddles 8 thereon, will be close to the bottom of the can in substantially the central area thereof.

With the mixer thus supported from the can, operation of the motor 1 and resultant rotation of shaft 6 will cause the paddles 8 to move, by centrifugal force, radially out to paint agitating and mixing position. Since the can remains closed except for the relatively small opening 17, the mixing operation is effected without any danger of the paint being splashed from the can.

As the paddles 8 are pivoted on the head 7 and relatively close to each other or folded when the shaft 6 is not rotating, said shaft and the paddles can be easily projected through the small opening 17 upon placement of the mixer on (or removing it from) the can.

Plug T is preferably a three-pronged plug for maximum safety, though in FIG. 1 the grounding prong is not visible.

Referring now to FIG. 3, there is illustrated a circuit diagram of the circuit in control box 2-2. The circuit includes the switch 2-1 having terminal pins 1-6 and the relay 2-4 having terminal pins 1-6. One of the AC lines 2-6 within supply cord 3 is connected to pins 2 and 5 in relay 2-4. The other AC line 2-7 is connected pin 6 in relay 2-4. Pins 1 and 4 in relay 2-4 are connected to pin 6 in switch 2-1 and pin 6 in relay 2-4 is connected to pin 3 of switch 2-1. Pin 3 in relay 2-4 and pins 2 and 5 of switch 2-1 are connected to the motor.

It is seen therefore that I have provided an improved paint mixer which can be operated without the fear of accidental starting and without the fear of accidental injury upon starting.

Since certain changes may be made in the above apparatus without departing from the scope of the invention herein involved it is intended that all matter contained in the above description and shown in the accompanying drawings shall be interrpreted as illustrative and not in a limiting sense.

What is claimed is:

1. A paint mixer for use in a paint can, said paint mixer comprising:

a. an electric motor, said electric motor having a motor shaft, b. a detachable extension shaft mechanically coupled to said motor shaft and having paint mixing elements thereon, c. means detachably supporting the electric motor on one side of the can, d. a power supply cord for electrically connecting said electric motor to an electrical power source, and e. a control box mechanically mounted on the electric motor and electrically interposed in the power supply cord leading to the electric motor for energizing and deenergizing the electric motor, said control box including a switch having an off position and at least one on position and a relay coupled to the switch to prevent restart of the electric motor on a loss of power from the electrical power source while the switch is in an on position until the switch is first returned to an off position and then moved to an on position, once the power has been restored.

2. The paint mixer of claim 1 and wherein the switch is a toggle switch.

3. The paint mixer of claim 1 and wherein the electric motor is a two speed motor and the switch is a double pole double throw switch having two on positions and a center off position.

4. The paint mixer of claim 1 and wherein said control box includes a housing having a top wall, said top wall including a recessed portion, said toggle switch being mounted within said recessed portion.

* * * * *